US006938997B2

(12) United States Patent
Toba et al.

(10) Patent No.: US 6,938,997 B2
(45) Date of Patent: Sep. 6, 2005

(54) INK CARTRIDGE AND VACUUM-PACKAGING PRODUCT CONTAINING THE SAME

(75) Inventors: Koichi Toba, Nagano-ken (JP); Satoshi Shinada, Nagano-ken. (JP); Hisashi Miyazawa, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 20 days.

(21) Appl. No.: 10/615,136

(22) Filed: Jul. 8, 2003

(65) Prior Publication Data

US 2004/0074804 A1 Apr. 22, 2004

(30) Foreign Application Priority Data

Jul. 9, 2002 (JP) ..... 2002-200589
Jul. 1, 2003 (JP) ..... 2003-189827

(51) Int. Cl.[7] ..... B41J 2/175
(52) U.S. Cl. ..... 347/86
(58) Field of Search ..... 347/86, 87; 220/203.11, 220/361; 53/403, 434; 206/206, 736

(56) References Cited

U.S. PATENT DOCUMENTS 5,040,002 A * 8/1991 Pollacek et al. ..... 347/87
5,500,663 A * 3/1996 Ujita et al. ..... 347/86
6,062,390 A 5/2000 Nakamura
6,511,168 B2 * 1/2003 Higuma ..... 347/86

FOREIGN PATENT DOCUMENTS

EP 1 125 747 A2 8/2001
EP 1 199 178 A1 4/2002
JP 04-232069 8/1992
JP 2000-255078 9/2000
JP 2002-205414 7/2002

OTHER PUBLICATIONS

European Search Report, Application No. 03014594.0–2304–, Dated Jun. 21, 2004.
Office Action from Chinese Patent Appln. No. 03146636.2 (Dec. 31, 2004), with English transl.

* cited by examiner

*Primary Examiner*—Anh T. N. Vo
(74) *Attorney, Agent, or Firm*—Stroock & Stroock & Lavan LLP

(57) ABSTRACT

An ink cartridge includes: an ink accommodating portion for holding ink; an air passage for making the ink accommodating portion communicate with the atmosphere; and a valve mechanism, provided in the air passage, including an air-releasing valve member for sealing a communication hole provided in a partition wall for separating an ink-accommodating-portion side that is a side close to the ink accommodating portion from an atmosphere side that is a side close to the atmosphere, in a direction from the ink-accommodating-portion side to the atmosphere side, wherein the air-releasing valve member has a contact portion for opening the air passage by receiving an external force from the atmosphere side to the ink-accommodating-portion side.

17 Claims, 17 Drawing Sheets

INK CARTRIDGE AND VACUUM-PACKAGING PRODUCT CONTAINING THE SAME

This patent application claims priority from Japanese patent applications Nos. 2002-200589 filed on Jul. 9, 2002 and 2003-189827 filed on Jul. 1, 2003, the contents of which are incorporated herein by reference.

BACKGROUND OF THE INVENTION

1. Field of the Invention

The present invention relates to an ink cartridge that is removably mounted on a carriage of an ink-jet recording apparatus including a recording head for performing recording of data such as characters or images by ejecting ink droplets from a nozzle opening, so as to supply ink to the recording head. More particularly, the present invention relates to an ink cartridge having an air-releasing valve and a vacuum-packaging product containing therein such ink cartridge.

2. Related Art

An ink cartridge for supplying ink to a recording head of an ink-jet recording apparatus includes: an ink chamber; an ink supply port that communicates with the ink chamber, to which an ink-supply needle can be inserted and which supplies the ink to the recording head through the ink-supply needle inserted therein; and an air passage for introducing ambient air into the ink chamber in accordance with reduction in the amount of the ink in the ink chamber with discharge of the ink via the ink supply port during consumption of ink.

However, since the ink chamber is in communication with the outside of the ink cartridge through the air passage, the ink in the ink chamber may leak into the outside of the ink cartridge through the air passage or change in quality, for example, become thick because of evaporation of solvent in the ink.

SUMMARY OF THE INVENTION

Therefore, it is an object of the present invention to provide an ink cartridge and a vacuum-packaging product containing that ink cartridge, which are capable of overcoming the above drawbacks accompanying the conventional art. The above and other objects can be achieved by combinations described in the independent claims. The dependent claims define further advantageous and exemplary combinations of the present invention.

According to the first aspect of the present invention, an ink cartridge comprises: an ink accommodating portion for holding ink therein; an air passage for communicating the ink accommodating portion with atmosphere; and a valve mechanism, provided in the air passage, including an air-releasing valve mechanism for sealing a communication hole provided in a partition wall that separates an ink-accommodating-portion side, that is a side close to the ink accommodating portion, from an atmosphere side, that is a side close to the atmosphere, in a direction from the ink-accommodating-portion side to the atmosphere side, wherein the air-releasing valve member has a contact portion operable to open the air passage by receiving an external force from the atmosphere side to the ink-accommodating-portion side. Thus, while the ink cartridge is not mounted onto an ink-jet recording apparatus, the air passage of the ink cartridge can close without fail, thereby preventing ink leak to the outside of the ink cartridge and also preventing ink characteristics from varying, for example, viscosity from changing to high due to evaporation of solvent contained in the ink.

The air passage may include a winding passage and a breathable filter that repels liquid in that order from the atmosphere, and the valve mechanism may be provided between the filter and the ink accommodating portion. Thus, even if the ink got into the atmosphere side of the air passage through the valve mechanism, the filter can prevent the ink from flowing farther.

The ink cartridge may further comprise a pressing member having an elastic force for pressing the air-releasing valve member in a direction from the ink-accommodating-portion side to the atmosphere side. Thus, while the ink cartridge is not mounted onto the recording apparatus, the air passage of the ink cartridge can be closed more steadily.

The ink cartridge may further comprise a hammer operable to come into contact with the contact portion of the air-releasing valve member to open the air passage, the hammer being pivotable around an axis. Thus, in a case where the ink cartridge has been mounted on the recording apparatus, the air passage of the ink cartridge can open by the hammer without fail.

The hammer may pivot around the axis in a direction perpendicular to a mounting direction of the ink cartridge onto a recording apparatus. Thus, the distance of the pivotal movement of the hammer when the ink cartridge is mounted on the recording apparatus can be made larger. Therefore, in the case where the ink cartridge has been mounted onto the recording apparatus, the air passage can be opened more surely by the hammer.

The ink cartridge may further comprise an air-releasing valve pressing member operable to move substantially in parallel to a mounting direction of the ink cartridge onto a recording apparatus, and the contact portion may be pressed by the air-releasing valve pressing member to open the air passage. Thus, without widening the size in the width direction of the ink cartridge, the distance of the movement of the air-releasing valve pressing member when the ink cartridge is mounted onto the recording apparatus can be made larger. Therefore, with progress of the mounting of the ink cartridge onto the recording apparatus, the air passage can be opened more surely by the air-releasing valve pressing member.

The air-releasing valve member may have a projecting portion extending along the mounting direction of the ink cartridge onto the recording apparatus to project from the communication hole toward the atmosphere side, the projecting portion being formed to be pressed by the air-releasing valve pressing member. Thus, with the progress of the mounting of the ink cartridge onto the recording apparatus, the projecting portion is pressed along the mounting direction by the air-releasing valve pressing member. Therefore, it is possible to open the air passage more surely.

The air-releasing valve pressing member may further include a pressing member having an elastic force for pressing said air-releasing valve member in a direction of said mounting direction of said ink cartridge onto said recording apparatus.

The contact portion may be pressed by the hammer via a film. Thus, the hammer can press the contact portion with a simple structure.

A face of a room accommodating the air-releasing valve pressing member, that is pressed against the recording apparatus, may be sealed with a film. Thus, with a simple structure, the air-open pressing member can be pressed from the outside of the room accommodating the air-releasing valve pressing member.

According to the second aspect of the present invention, a vacuum-packaging product comprises: an ink cartridge mentioned above; and an outer packaging member operable to cover the ink cartridge, the outer packaging member being like a bag, wherein a pressure inside the outer packaging member is reduced to seal the ink cartridge. Thus, when the ink cartridge has been accommodated in the outer packaging member, a force is applied to the air-releasing valve by a negative pressure caused by pressure reduction inside the outer packaging member, in a direction which blocks the air passage. Therefore, it is possible to prevent the air-releasing valve from being opened by the negative pressure, thereby preventing ink leak from the ink cartridge through the air-releasing valve without fail.

The summary of the invention does not necessarily describe all necessary features of the present invention. The present invention may also be a sub-combination of the features described above. The above and other features and advantages of the present invention will become more apparent from the following description of the embodiments taken in conjunction with the accompanying drawings.

BRIEF DESCRIPTION OF THE DRAWINGS

FIG. 6A shows a state in which the ink chamber contains no ink; FIG. 6B shows a state in which ink in the second ink chamber was consumed; and FIG. 6C shows a state in which ink in the first ink chamber was consumed.

DETAILED DESCRIPTION OF THE INVENTION

The invention will now be described based on the preferred embodiments, which do not intend to limit the scope of the present invention, but exemplify the invention. All of the features and the combinations thereof described in the embodiment are not necessarily essential to the invention.

Figure 1:
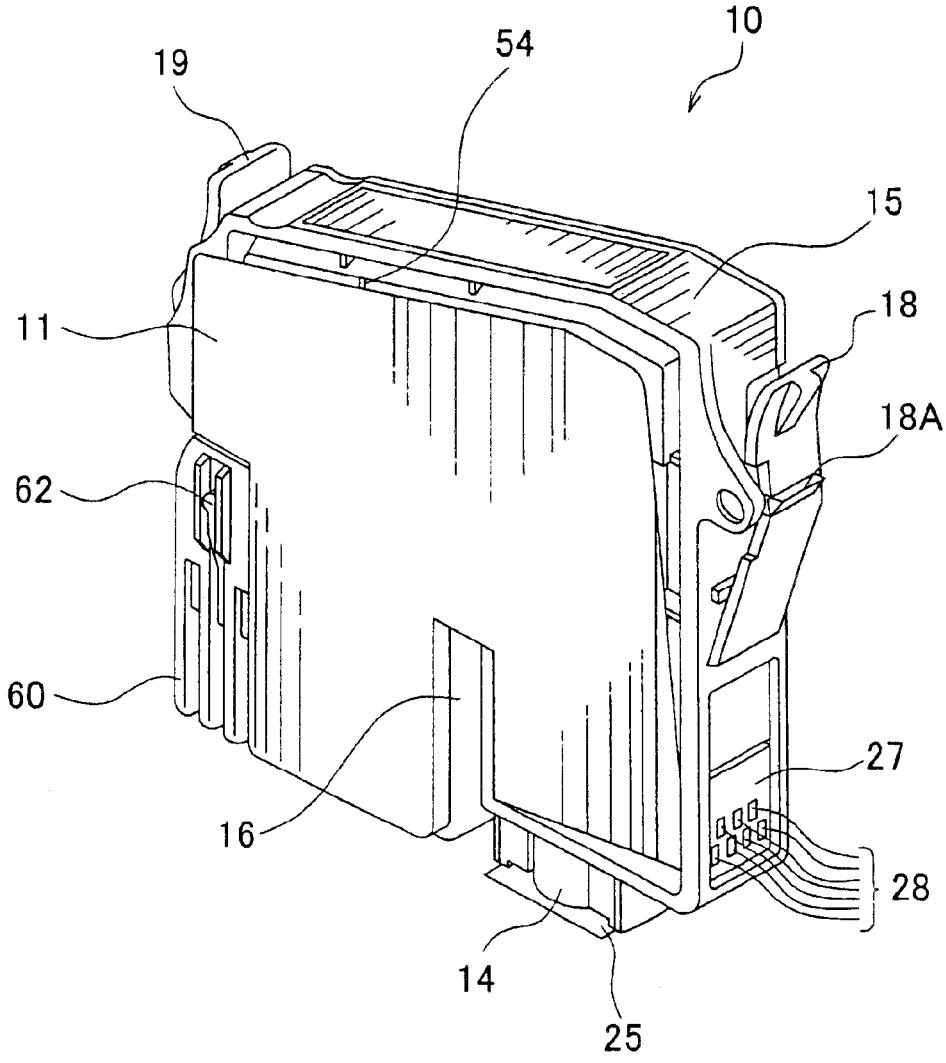
FIG. 1 is a front perspective view of an ink cartridge according to the first embodiment of the present invention is applied.
Figure 2:
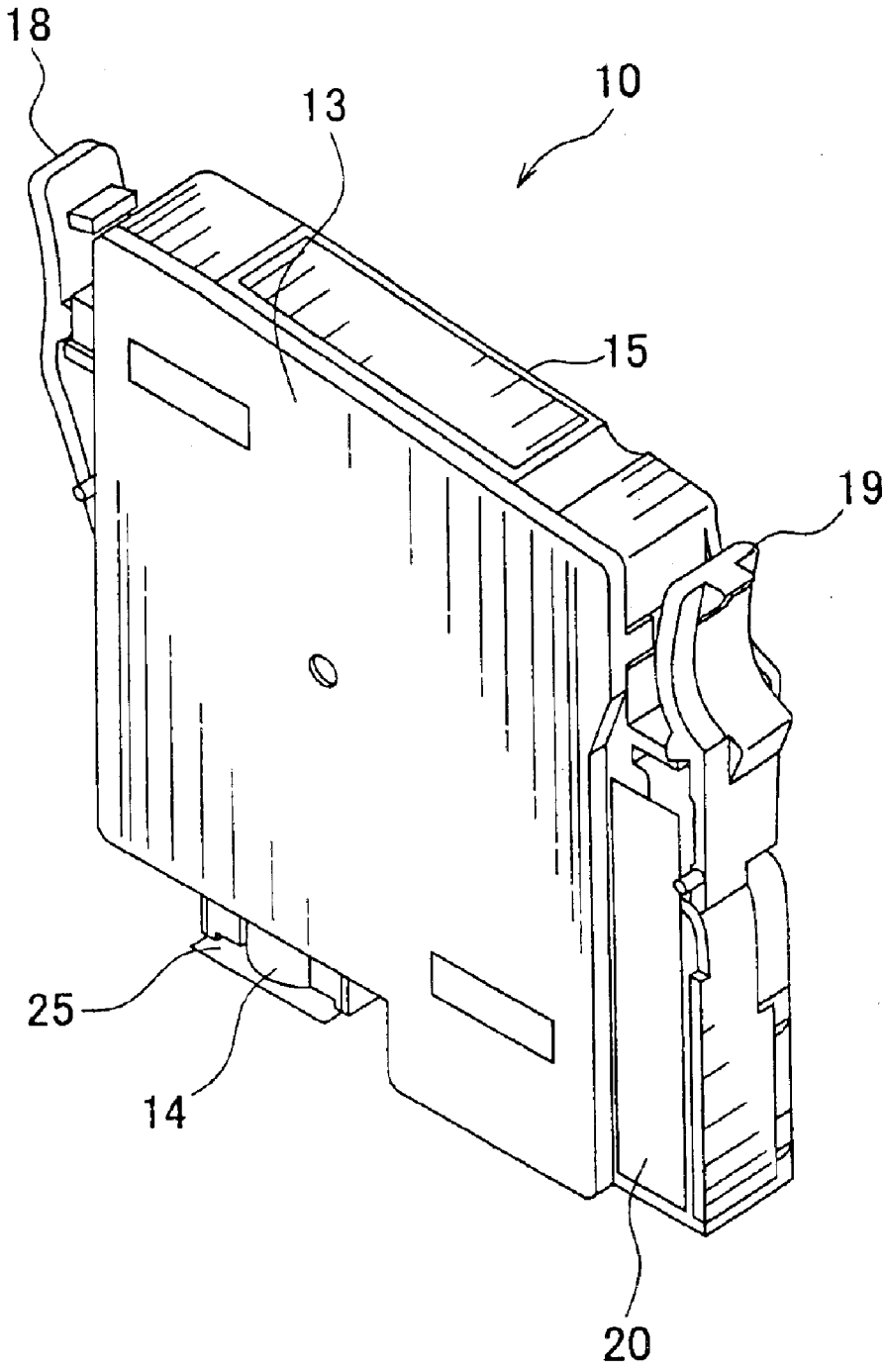
FIG. 2 is a back perspective view of the ink cartridge shown in FIG. 1.

FIGS. 1 and 2 are perspective views showing an ink cartridge 10 according to the first embodiment of the present invention, showing the front and back thereof, respectively. The ink cartridge of the present embodiment is constructed in such a manner that an ink chamber (ink accommodating portion) is in communication with the outside of the ink cartridge 10 (atmosphere) through an air passage while the ink cartridge is mounted on a carriage of an ink-jet recording apparatus, thereby ink can be supplied to a recording head. On the other hand, the ink cartridge of the present embodiment is also constructed so as to cause a valve mechanism to block the air passage while the ink cartridge is not mounted on the carriage, thereby preventing ink leak to the outside and evaporation of solvent in the ink. Moreover, the ink cartridge 10 of the present embodiment has a structure which can block the air passage more steadily in a case where it is vacuum-packed.

Figure 4:
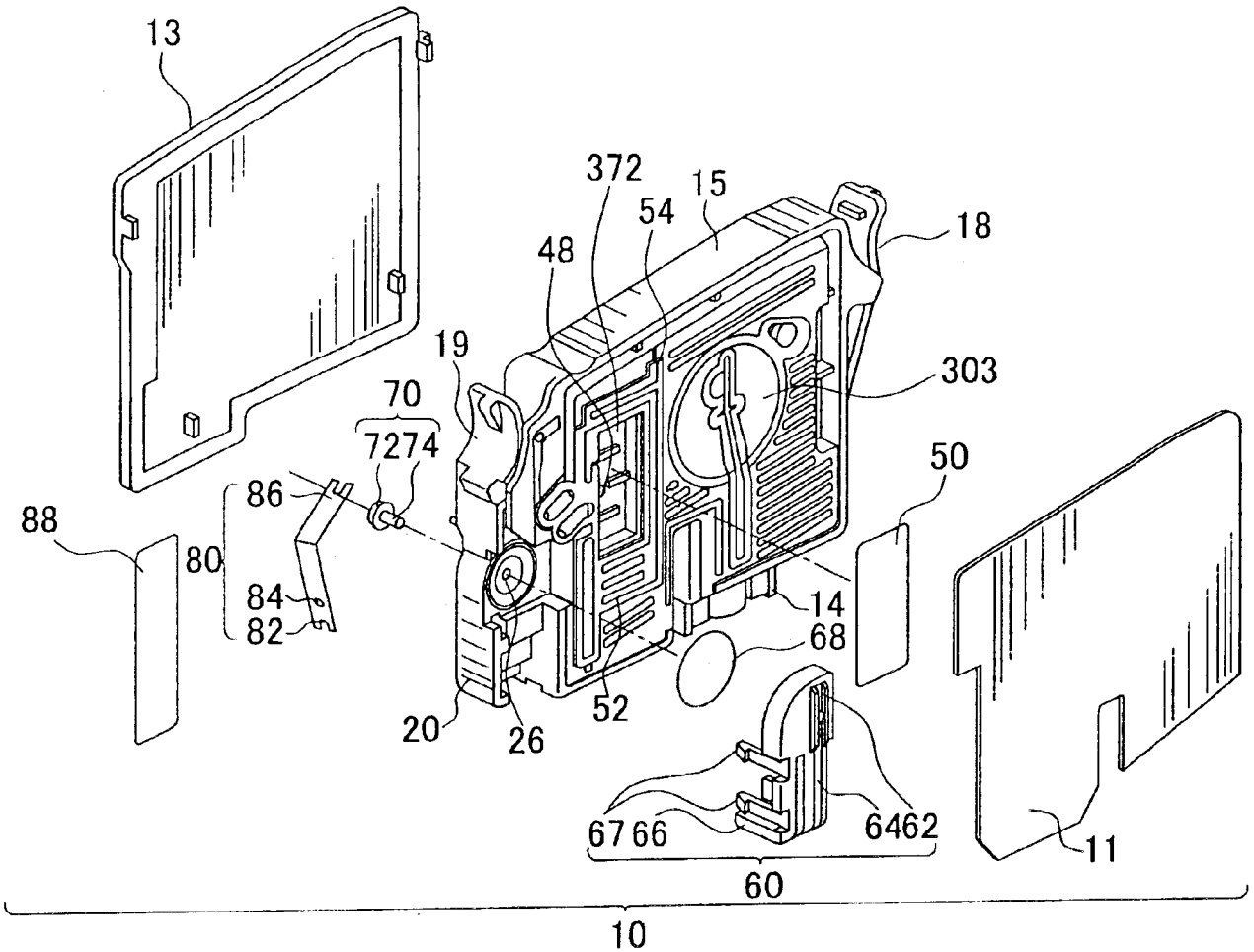
FIG. 4 is an exploded perspective view of the ink cartridge.

The ink cartridge 10 of the present embodiment includes an ink-chamber main body 15 that is opened on the back side so as to form an ink chamber for accommodating ink therein, and a cover 13 that seals the opening of the ink-chamber main body 15 by vibration welding, heat welding or the like, as shown in FIG. 4. In the front face wall of the ink-chamber main body 15, a groove is provided for forming the air passage described later. By making a film 11 shown in FIG. 1 adhere to almost all of the front face of the ink-chamber main body 15, the groove is sealed so that it can serve as the air passage. Moreover, a part of the opening of the ink-chamber main body 15 is sealed with another film. Then, by sealing the whole area of the opening of the ink-chamber main body with the cover 13, the ink chamber is defined in the ink-chamber main body 15. The thus defined ink chamber serves as an ink container as a single unit.

On the bottom of the ink cartridge 10, a hollow ink supply port 14 is formed that communicates with the ink chamber through an ink flow path. When the ink cartridge 10 was shipped, a sealing-film 25 is put on the ink supply port 14 to prevent ink leak. However, this film 25 is broken by an ink-supply needle when the ink cartridge 10 is mounted onto the ink-jet recording apparatus. In the ink supply port 14, a valve mechanism may be provided for closing the ink flow path in the ink supply port 14 when the ink cartridge 10 is not mounted on the ink-jet recording apparatus. The ink cartridge 10 having such a valve mechanism can be repeatedly mounted and removed onto/from the ink-jet recording apparatus even if there is ink left in the ink cartridge 10.

As shown in FIG. 1, a circuit board 27 is mounted on the right side face of the ink cartridge 10 seen from the front thereof. The circuit board 27 is provided with a semiconductor memory such as an EEPROM on the back face and a plurality of contact terminals 28 on the front face. These contact terminals 28 are arranged at such positions that they are in contact with electrodes of an external control device while the ink cartridge 10 is mounted onto the ink-jet recording apparatus so as to allow reading and writing of information on ink, for example data about the specification of and consumption amount of ink from/to the semiconductor memory device as needed. This feature allows the ink cartridge 10 to hold necessary information on the ink even if it is detached from the ink-jet recording apparatus. Thus, when the ink cartridge 10 is mounted onto the ink-jet recording apparatus again, an appropriate printing control can be achieved by reading the information held by the ink cartridge 10 mounted. The circuit board 27 can be arranged to be removably mountable onto the ink cartridge 10. Moreover, the semiconductor memory may be provided on a different position on the ink cartridge 10 from the circuit board 27 in such a manner that the semiconductor memory and the contact terminals 28 are connected via wire connection.

Moreover, the ink cartridge 10 includes a flexible lock lever 18 and a flexible grip lever 19 formed on two side faces of the ink cartridge 10 that are opposed to each other, the levers 18 and 19 extending upward. These levers 18 and 19 are formed of polypropylene (PP), for example, integrally with the ink-chamber main body 15.

Moreover, a slit 16 is provided on the front side of the ink cartridge 10 in the vicinity of the ink supply port 14 substantially at the center in the width direction of the ink cartridge 10, as shown in FIG. 1. The slit 16 extends along a direction of insertion of the ink-supply needle 12 into the ink supply port 14. As described later referring to FIGS. 3A and 3B, the slit 16 can engage with a guide projection 117 provided to straightly stand from the area in the vicinity of the ink-supply needle 112 on the carriage 110 when the ink cartridge 10 is mounted onto the carriage 110, thereby regulating the orientation of the opening of the ink supply port 14 in such a manner that the plane of the opening of the ink supply port 14 is precisely perpendicular to the ink-supply needle 112 before the ink supply port 14 reaches the ink-supply needle 112. Thus, the ink-supply needle 112 is inserted into the ink supply port 14 in a state where the needle 112 is precisely positioned.

Furthermore, an identification member 60, formed by a separate member from the ink-chamber main body 15, is provided at one corner located in the lower part of the front face of the ink cartridge 10. The identification member 60 has a different shape depending on the type of the ink cartridge 10. For example, the identification member 60 of the ink cartridge 10 for a certain color is different from that for another color. The identification member 60 is designed to engage with an identification projection 118 on the carriage 110 described later, like fitting between a key and a keyhole. Thus, insertion of the ink cartridge 10 into other regions than a predetermined region, i.e., wrong insertion can be prevented. A hammer 62, details of which will be described later, is molded integrally with the identification member 60.

Figure 3A:
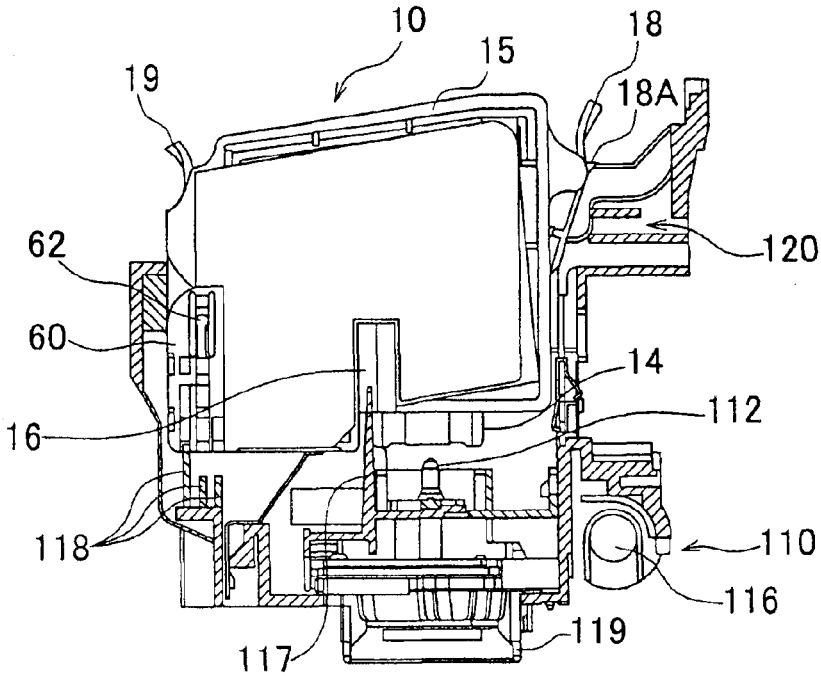
FIGS. 3A and 3B are perspective views showing a process for mounting the ink cartridge on a carriage of a recording apparatus.
Figure 3B:
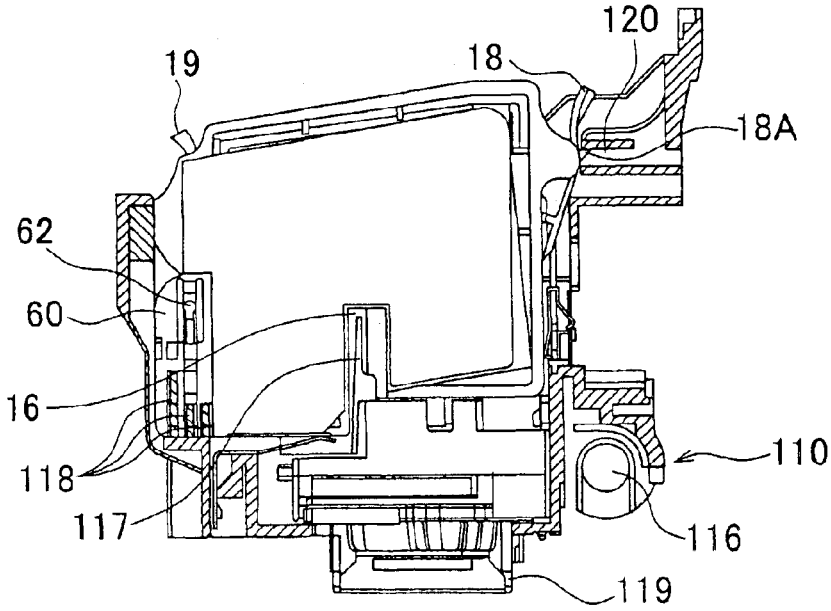

FIGS. 3A and 3B are side cross-sectional view showing a process for mounting the ink cartridge 10 of the present invention onto the carriage 110 of the ink-jet recording apparatus. FIG. 3A shows a state during the mounting process, while FIG. 3B shows a state when the ink cartridge 10 has been completely mounted on the carriage 110. The carriage 110 is placed on a shaft 116 of the ink-jet recording apparatus so that the carriage 110 can reciprocate in a main scanning direction. The carriage 110 is arranged to allow a plurality of ink cartridges 10 respectively accommodating different types or kinds of ink to be mounted thereon. More specifically, four different ink cartridges 10 that accommodate four colors of ink, i.e., yellow, cyan, magenta and black, respectively, can be mounted on the carriage 110 to achieve full-color printing. Please note that the term "different types of ink" is not limited to the reference to different colors of ink. A plurality of ink cartridges 10 accommodating a plurality of types of ink that are different in nature, component, or the like although they are the same in color can be mounted on the carriage 110.

When the ink cartridge 10 is mounted onto the carriage 110, the ink cartridge 10 is pushed right down from above the carriage 110 while being gripped at the levers 18 and 19 extending from the right and left side faces of the ink cartridge 10 with the thumb and index finger of the user. During this operation, the slit 16 formed on one face of the ink-chamber body 15 engages with a guide projection 116 extending upward from the region near the ink-supply needle 112 on the carriage 110. This engagement prevents the mounting of the ink cartridge 10 in a wrong direction. When the ink cartridge 10 has fitted completely, an engagement projection 18A provided on a part of the lock lever 18 engages with an engagement groove 120, thereby preventing disengagement of the ink cartridge 10 from the carriage 110 unless the lock lever 18 is pushed toward the ink-chamber body 15. Also, when the ink cartridge 10 has been mounted on the carriage 110, the ink-supply needle 112 that is in communication with the recording head 119 is inserted into the ink supply port 14 formed at the bottom of the ink cartridge 10, thereby making the ink chamber of the ink cartridge 10 communicate with the recording head. In this state, when the print head 119 is driven to eject ink therefrom, the ink in the ink cartridge 10 is supplied to the recording head 119. Although the grip lever 19 is formed to allow the user to stably hold the ink cartridge 10 with his/her hand, a concave portion and a protrusion for engaging with this concave portion may be formed on the carriage 110 and the grip lever 19, respectively.

The ink cartridge 10 has an air passage for allowing communication between the ink chamber and the atmosphere. The air passage is separated into an ink-side passage 30 that is in communication with the ink chamber and an atmosphere-side passage 40 that is in communication with the atmosphere with an air-releasing valve (air-releasing valve member) 70 provided therebetween.

Figure 5A:
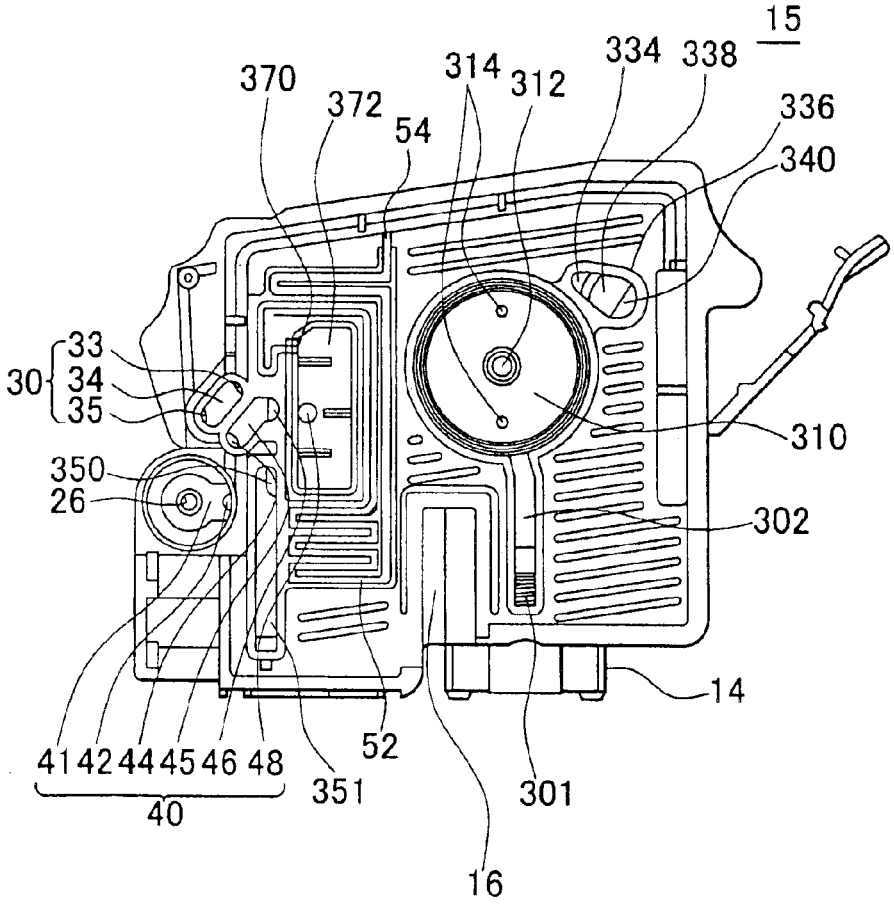
FIGS. 5A and 5B are plan view and perspective view of an ink chamber in FIGS. 3A and 3B seen from the front side thereof, showing a main part of the ink chamber.
Figure 5C:
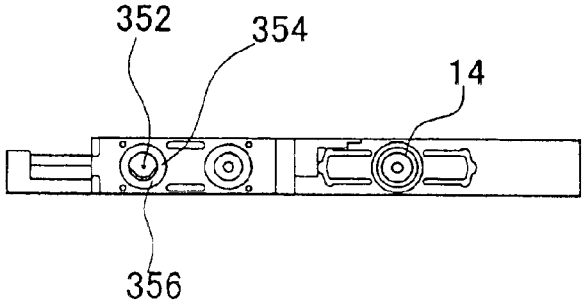
FIG. 5C is a plan view of the ink cartridge seen from the bottom thereof.
Figure 5B:
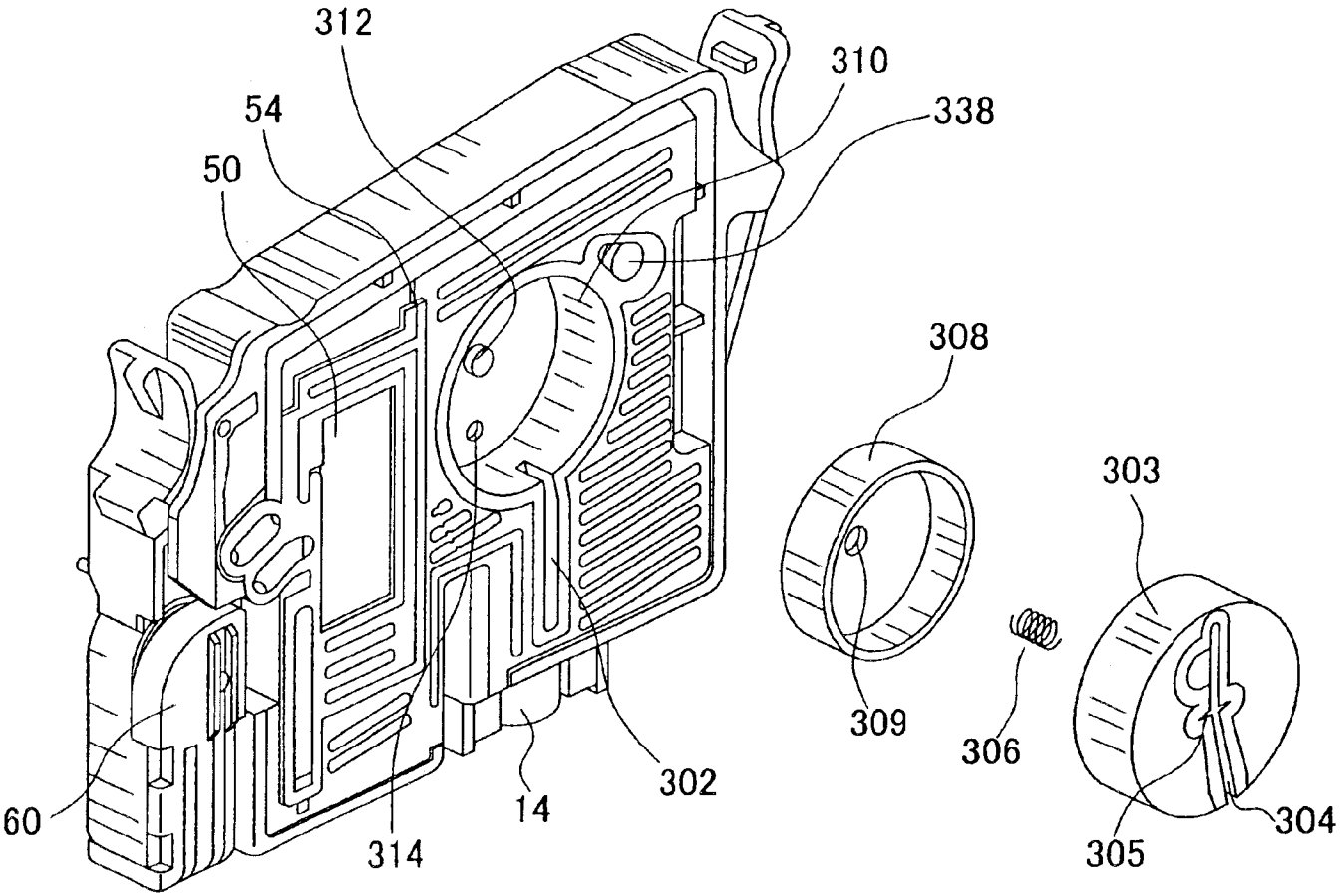
Figure 6A:
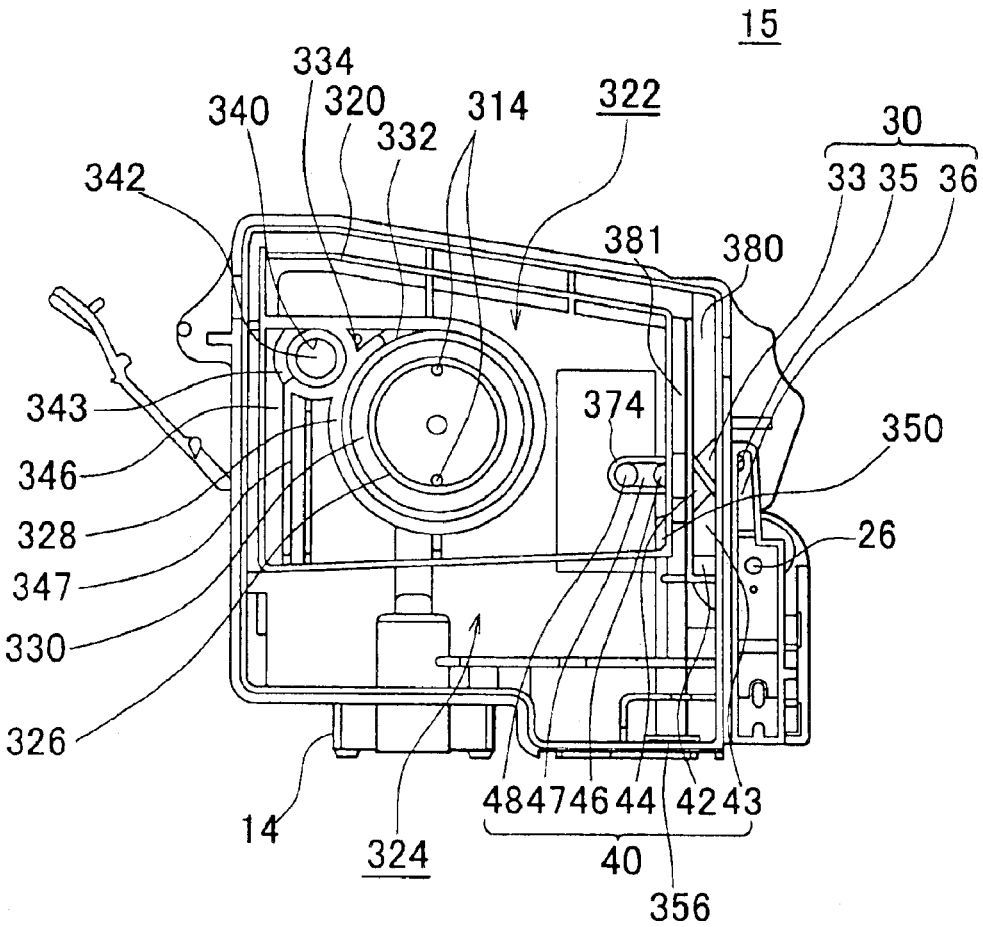
FIGS. 6A, 6B and 6C are plan views of the ink chamber in FIGS. 3A and 3B seen from the back side thereof.
Figure 6B:
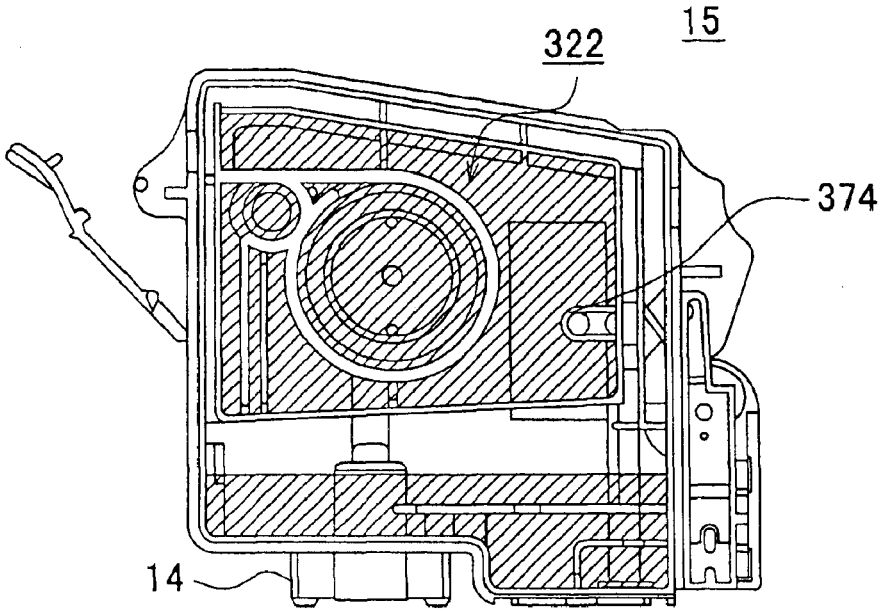
Figure 6C:
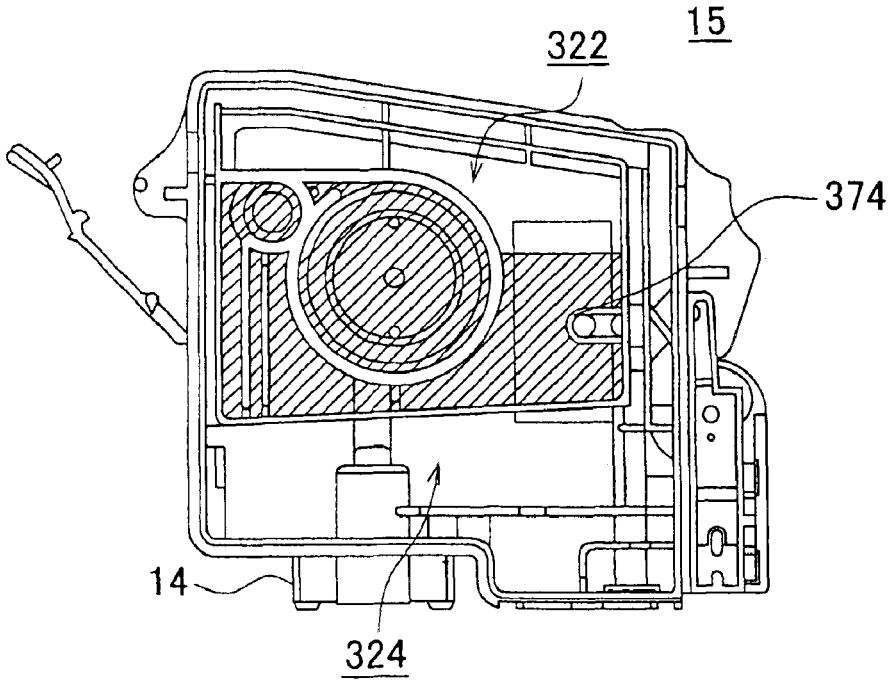

FIG. 4 is an exploded perspective view of the ink cartridge 10 seen from the front side thereof. FIG. 5A is a plan view of the ink-chamber main body 15 seen from the front side thereof, in which the film 11, a diaphragm valve 308 and a cap 303 that can fit into a circular concave portion 310 and a coil spring 306 interposed between the diaphragm valve 308 and the cap 303 are removed; FIG. 5B is a perspective view in which the diaphragm valve 308 and cap 303 and the coil spring 306 are also removed; and FIG. 5C is a plan view of the ink cartridge 10 seen from the bottom thereof. FIGS. 6A, 6B and 6C show the back of the ink-chamber main body 15, in which the cover 13 is removed.

Referring to FIGS. 4, 5A–5C and 6A, the structure of the ink cartridge 10 according to an embodiment of the present invention is described.

First, the ink flow path is described. As shown in FIGS. 5A and 5B, the tube-like ink supply port 14 communicate with one end of a groove 302 through a bore 301 formed on the inner wall of the ink supply port 14. The other end of the groove 302 is in communication with a groove 304 formed on the surface of the cap 303. The cap 303 has a through hole 305 at the center thereof. The diaphragm valve 308, that is formed of flexible material such as elastomer, has a center hole 309. The center hole 309 is formed to oppose to a protrusion 312 formed as a sealing portion on the bottom of the circular concave portion 310. By bringing the center hole 309 and the protrusion 312 into contact with each other and moving them away from each other, communication between the ink-chamber side of the diaphragm valve 308 and the ink-supply-port side is controlled. More specifically, while the recording head 119 is not emitting ink, the center hole 309 and the protrusion 312 are in contact with each other, thereby blocking the ink flow path. On the other hand, when the recording head 119 emits the ink, the pressure on the ink-supply-valve side of the diaphragm valve 308, which is the side close to the ink supply valve 14, is reduced and then, at a predetermined pressure, causes deformation of the diaphragm valve 308 by the predetermined pressure (negative pressure). This deformation of the diaphragm valve 308 causes the center hole 309 to move away from the protrusion 312, thereby allowing communication between the both sides of the diaphragm valve 308 so as to supply the ink in the ink chamber to the ink supply port 14. The above circular concave portion 310 has two holes 314 on the bottom thereof, which extend to reach the back of the ink cartridge 10.

Next, the ink cartridge 10 is described referring to FIG. 6A that shows the back thereof. In the back of the ink cartridge 10, an ink chamber for accommodating ink is provided. This ink chamber is divided into the first ink chamber 322 surrounded by a peripheral wall 320 and the second ink chamber 324 located outside the first chamber 322. On the peripheral wall 320, the second circular wall 328 formed to have the same height as the peripheral wall 320 and the like, a film (not shown) is put to adhere them, thereby defining the first ink chamber 322.

The two holes 314 on the bottom of the circular concave portion 310 are in communication with a concave portion 330 provided in the first ink chamber 322, which is defined by the first circular wall 326 and the second circular wall 328 higher than the first circular wall 326. The upper edge of the first circular wall 326 is set lower than the upper edge of the second circular wall 328, and is arranged so as to allow a filter in form of plate or the like to be formed thereon. The second circular wall 328 has a notch 332 via which the concave portion 330 is in communication with a hole 334 that extends toward the front of the ink cartridge 10. As shown in FIG. 5A, the hole 334 goes back to the back of the ink cartridge 10 via a concave portion 338 having a tear drop shape and a hole 340 that are defined by a wall 336 formed on the front side of the ink cartridge 10. A concave portion on the back of the ink cartridge 10, which communicates with the hole 340, is filled with a filter 342 provided therein. Moreover, the hole 340 communicates with the first ink chamber 322 via the filter 342, a notch 343, and an extending groove 346 formed by the peripheral wall 320 and a partition wall 347 having the same height as that of the periphery wall 320.

In a lower-right corner region of the first ink chamber 322, a hole 350 reaching the front of the ink cartridge 10 is formed, and is in communication with a hole 352 formed on the bottom of the ink cartridge 10, which is shown in FIG. 5C, through a communication groove 351 shown in FIG. 5A. The hole 352 reaches a notch 356 via a concave portion 354. This notch 356 extends to reach the second ink chamber 324 formed on the backside of the ink cartridge 10.

The concave portion 354 is sealed with a film (not shown) so as to form a space serving as a part of the air passage.

Next, the structure of the air passage will be described. As is seen in FIG. 5A, on the front side of the ink-chamber main body 15, a passage 52 is formed by sealing an winding groove with the film 11 shown in FIG. 4, the groove being formed to have such a size and length that it is possible to suppress evaporation of ink. One end of the passage 52 is opened as an atmosphere opening 54. The other end 370 of the passage 52 is connected to a rectangular concave portion 372 which has a hole 48 extending through the bottom of the concave portion 372 to reach the back of the ink-chamber main body 15. A filter 50 (see FIG. 4) of breathable material repelling ink is arranged in the concave portion 372 to be located at an intermediate position of the concave portion 372, thereby partitioning the concave portion 372 into a room that communicates with the passage 52 and a room that communicates with the hole 48. This filter 50 removes dust and moisture in the atmosphere and also prevents leak of ink getting out from the ink-chamber side to the outside. The ambient air that passed through the hole 48 toward the back goes of the ink-chamber main body 15 to the front thereof again through a groove 47 surrounded by a peripheral wall 374 shown in FIG. 6A and a hole 46 formed on the bottom of the groove 47. The hole 46 reaches a groove 45 provided on the front face. At the other end of the groove 45, a hole 44 is formed to extend to the backside of the ink-chamber main body 15. Since the film 11 is put on the whole area of the ink-chamber main body 15 on the front side, the groove 45 is also sealed with the film 11. Thus, the atmosphere passes through a single air passage formed by the hole 46, groove 45 and hole 44, so that the atmosphere flows toward the back again. The hole 44 extends through a longitudinal groove 43 to reach the hole 42 formed in a lower part of the groove 43, and then extends toward the front again. On the front side of the ink-chamber main body 15, the hole 42 communicates with an inside-outside communication hole 26 through a groove 41. The inside-outside communication hole 26 communicates with a hole 35 via a concave portion 36 on the back side of the ink-chamber main body 15. As shown in FIG. 5A, the hole 35 communicates with a hole 33 via a groove 34. The hole 33 communicates with a groove 380 extending upward, as shown in FIG. 6A, which communicates with an upper part of the second ink chamber 324 via a groove 381 extending downward.

Returning to FIG. 4, in the ink-chamber main body 15 are formed an ink-side passage 30 for achieving communication between the ink accommodating portion and the inside-outside communication hole 26 and an atmosphere-side passage 40 for achieving communication between the inside-outside communication hole 26 and the atmosphere. By making both the passages 30 and 40 communicate with each other, a single air passage is formed so as to introduce the atmospheric air into the ink accommodating portion from the atmosphere. In the ink cartridge 10 of the present embodiment, a valve mechanism is arranged for closing and opening the inside-outside communication hole 26.

As shown in FIG. 4, an air-releasing valve 70 forming the valve mechanism includes a base portion 72 and a projecting portion 74 that are molded integrally with each other in such a manner that the projecting portion 74 has a smaller diameter than that of the base portion 72. The projecting portion 74 is inserted into the inside-outside communication hole 26 from the backside of the ink cartridge 10, i.e., from the back in FIG. 4. The projecting portion 74 has such a length that the tip thereof projects from the inside-outside communication hole 26 toward the front of the ink cartridge 10.

Figure 7:
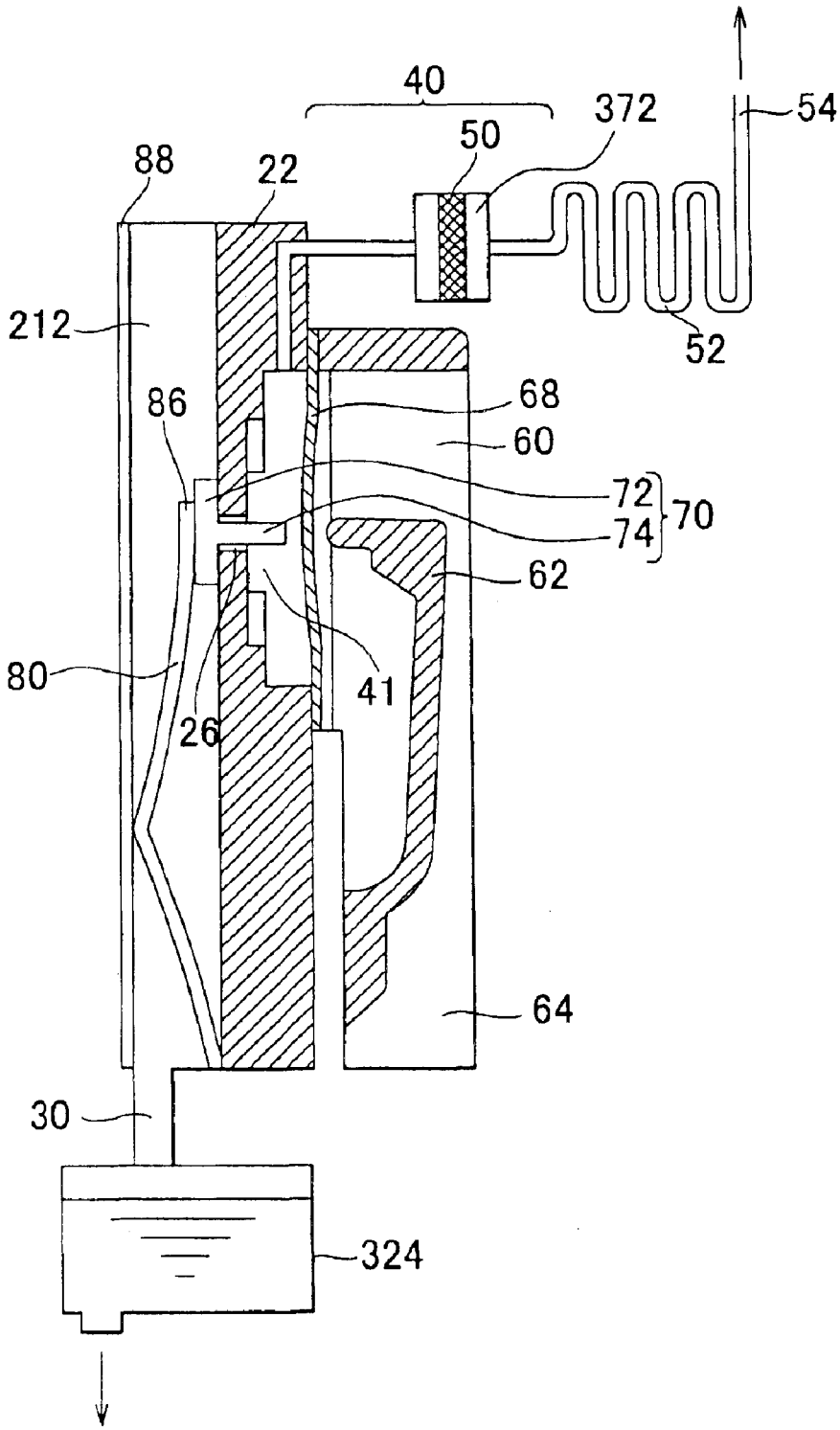
FIG. 7 is a partial cross-sectional view around an atmosphere valve accommodating part, for explaining an operation of the ink cartridge.

A pressing member 80 formed by a plate spring that is bent presses the air-releasing valve 70 from the backside of the ink cartridge 10. Thus, in a normal state, the side of the base portion 72 of the air-releasing valve 70, that is the close side to the inside-outside communication hole 26, is brought into contact with the wall in which the inside-outside communication hole 26 is formed by an elastic force applied by the pressing member 80 in a sealing manner. The pressing member 80 is not limited to the plate spring. For example, the pressing member 80 may be formed by a coil spring or an elastic body of resin. The pressing member 80 is constructed in such a manner that one end of the plate spring 82, 84 is fixed to the ink-chamber main body 15 while the other end 86 presses the air-releasing valve 70. Thus, communication between the outside and the inside of the ink chamber is not achieved in the normal state. Therefore, while the ink cartridge 10 is not mounted onto the ink-jet recording apparatus, it is possible to prevent ink leak from the ink chamber and evaporation of solvent in the ink held in the ink chamber. The pressing member 80 is provided in a space 212 between a part 22 of the inner wall of the ink cartridge 10 and a film 88, as schematically shown in FIG. 7. This space 212 serves as a part of the air passage.

The identification member 60 is attached to the front side of an air-releasing valve accommodating portion 20, and is formed by a base portion 66, an engagement portion 67 that extend from the base portion 66 and can engage with a part of the air-releasing valve accommodating portion 20, a groove 64 that can engage with an identification protrusion 118 on the carriage 110 of the ink-jet recording apparatus, and a resilient hammer 62 provided on an end of the groove 64. When the identification member 60 has been attached to the air-releasing valve accommodating portion 20, the hammer 62 is placed at such a position that it is opposed to the projecting portion 74 of the air-releasing valve 70. In other words, the projecting portion 74 serves as a contact portion for opening the air passage by receiving an external force in a direction from the atmosphere side to the ink-chamber side.

A film 68 formed of, for example, polypropylene is located between the projecting portion 74 of the air-releasing valve 70 and the hammer 62 of the identification member 60 to seal the periphery of the inside-outside communication hole 26 in an airtight manner from the front side of the ink cartridge 10, thereby forming the air passage from the through hole 42 to the inside-outside communication hole 26 as a sealed space.

Next, referring to FIGS. 5A, 5B and 5C, ink flow from the ink supply port 14 to the ink chamber is described in that order. When the ink cartridge 10 has been mounted onto the carriage 110 and the ink-jet recording apparatus has started a printing operation, ink is supplied from the ink supply port 14 to the recording head 119. The ink supply port 14 forms a single ink flow path together with the bore 301 communicating with the ink supply port 14, the groove 302, the groove 304 and through hole 305 of the cap 303 and the hole 309 of the diaphragm valve 308, so that that ink path finally reaches the inside of the circular concave portion 310. To the circular concave portion 310, the ink is supplied from the back region of the ink-chamber main body 15 (see FIGS. 6A–6C) through two holes 314. In the back region of the ink-chamber main body 15, the ink is supplied from the hole 334, flows through the notch 332, and then passes above the upper edge of the first circular wall 326 that has a lower height, so as to reach the two holes 314. The ink to the hole 334 is supplied from the first ink chamber 322 via the groove 338, the hole 340 reaching the back of the ink-chamber main body 15, the filter 342 inserted into the hole 340 and the extending groove 346.

To the first ink chamber 322, the ink is supplied from the second ink chamber 324 along the following flow path. The first ink chamber 322 communicates with the second ink chamber 324 via the hole 350 of the first ink chamber 322, the hole 352, the concave portion 354 on the bottom of the ink-chamber main body 15 and the notch 356.

As described above, since the air passage communicates with the second ink chamber 324 only, the ink in the ink chamber is reduced in the following manner. First, ink in the second ink chamber 324 is reduced. Then, after the ink in the second ink chamber 324 has been completely consumed to be replaced with air, ink in the first ink chamber 322 starts to be reduced. The ink in the second ink chamber 324 formed lower than the first ink chamber 322 in the direction of gravity goes out from the notch 356 as an outlet port, then alternately passes through the front-side region and back-side region of the ink-chamber main body 15 so as to reach the first ink chamber 322, and finally reaches the ink supply port 14 after passing through the circular concave portion 310 in which the diaphragm valve 308 is provided.

FIG. 6B shows a state in which the ink in the second ink chamber 324 of the ink cartridge 10 is being reduced, and FIG. 6C shows a state in which ink consumption made progress from the state of FIG. 6B so that the ink in the first ink chamber 322 is being reduced. Thus, since the atmospheric air does not gent into the first ink chamber 322 even when the ink surface in the second ink chamber 324 went down, the ink surface in the first ink chamber 322 does not go down.

The reason why the ink in the first ink chamber 322 does not flow backward into the second ink chamber 324 in the state shown in FIG. 6C is that the space above the ink surface in the first ink chamber 322 is not in communication with the atmosphere and the ink forms meniscus in the notch 356 to prevent the ink from flowing downward by a meniscus force.

FIG. 7 is a partial cross-sectional view showing a region in the vicinity of the air-releasing valve accommodating portion 20, that explains the operation of the ink cartridge 10. In FIG. 7, the second ink chamber 324 in the ink chamber, the ink-side passage 30 and the atmosphere-side passage 40 are simplified.

As shown in FIG. 7, in a case where the ink cartridge 10 is not mounted onto the ink-jet recording apparatus or a case where the ink cartridge 10 is in course of the mounting operation onto the ink-jet recording apparatus, the hammer 62 of the identification member 60 is located slightly away from the film 68 or is in near contact with the film 68. This position of the hammer 62 is an initial position. Thus, the air-releasing valve 70 pressed by one end 86 of the pressing member 80 blocks the inside-outside communication hole 26 with the base portion 72 of the valve 70 from the side close to the second ink chamber 324, i.e., from the left side of the air-releasing valve accommodating portion 20 in FIG. 7.

Figure 8:
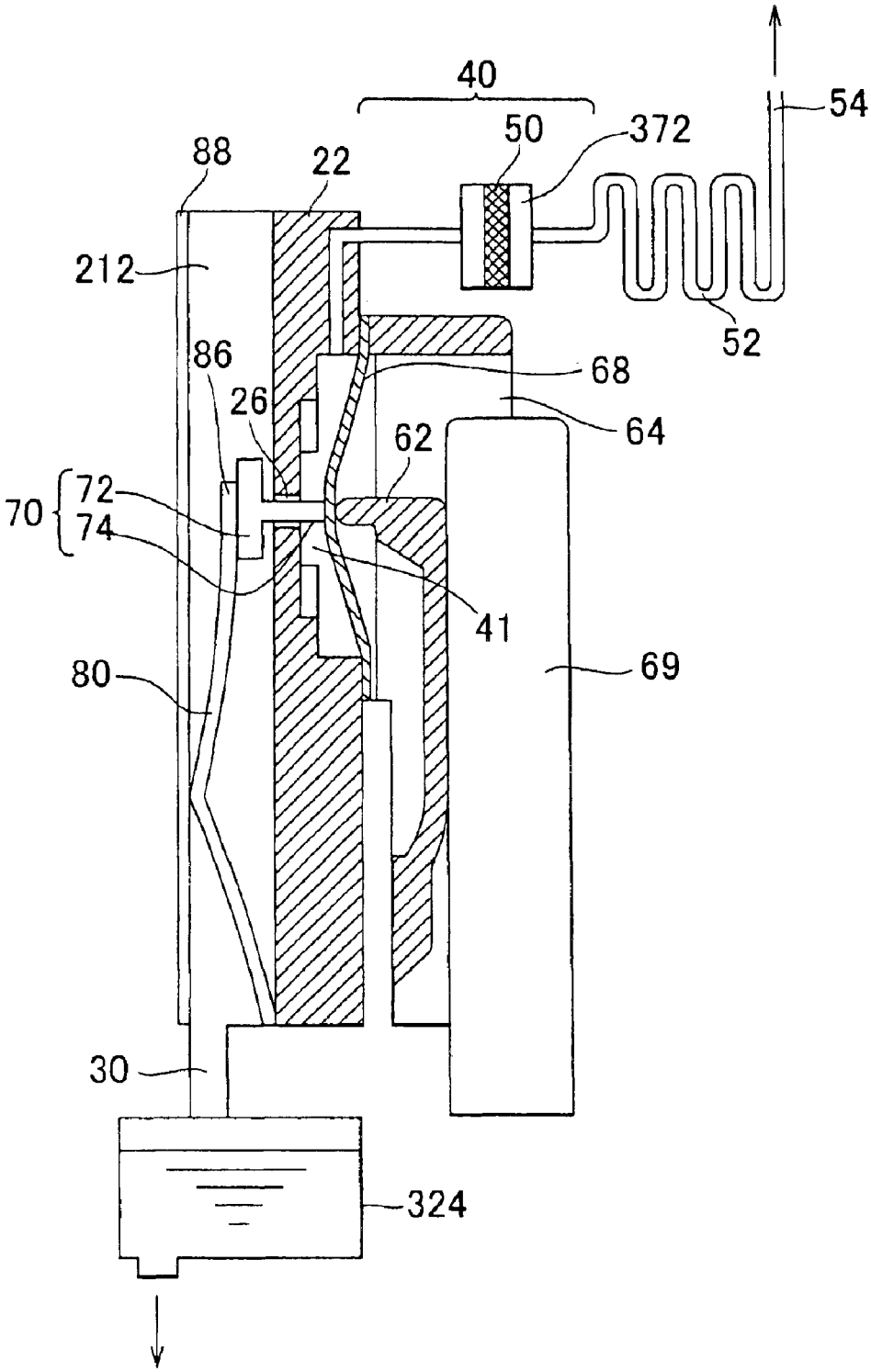
FIG. 8 is a partial cross sectional view around the atmosphere valve accommodating part, for explaining the operation of the ink cartridge in a case where the ink cartridge is mounted onto the ink-jet recording apparatus.

FIG. 8 is a partial cross-sectional view showing the region in the vicinity of the air-releasing valve accommodating portion 20, that explains the operation of the ink cartridge 10 while the ink cartridge 10 is mounted onto the ink-jet recording apparatus. When the ink cartridge 10 has been mounted onto the ink-jet recording apparatus, an engagement piece 69 that is a portion of the above-described identification protrusion 118 provided in the ink-jet recording apparatus enters the groove 64 of the identification member 60, thereby pressing the hammer 62 against the film 68. The pressed hammer 62 causes elastic deformation of the film 68 and also displaces the air-releasing valve 70 to the left in FIG. 8 against the force applied by the pressing member 80. Thus, the front side and the back side of the inside-outside communication hole 26 become in communication with each other, and therefore the inside of the second ink chamber 324 becomes in communication with the outside of the ink cartridge 10 via the inside-outside communication hole 26. In this manner, air can be introduced into the inside of the second ink chamber 324, and it is possible to supply ink from the ink supply port 14 via the ink-supply needle 112 to the ink-jet recording apparatus.

Figure 9:
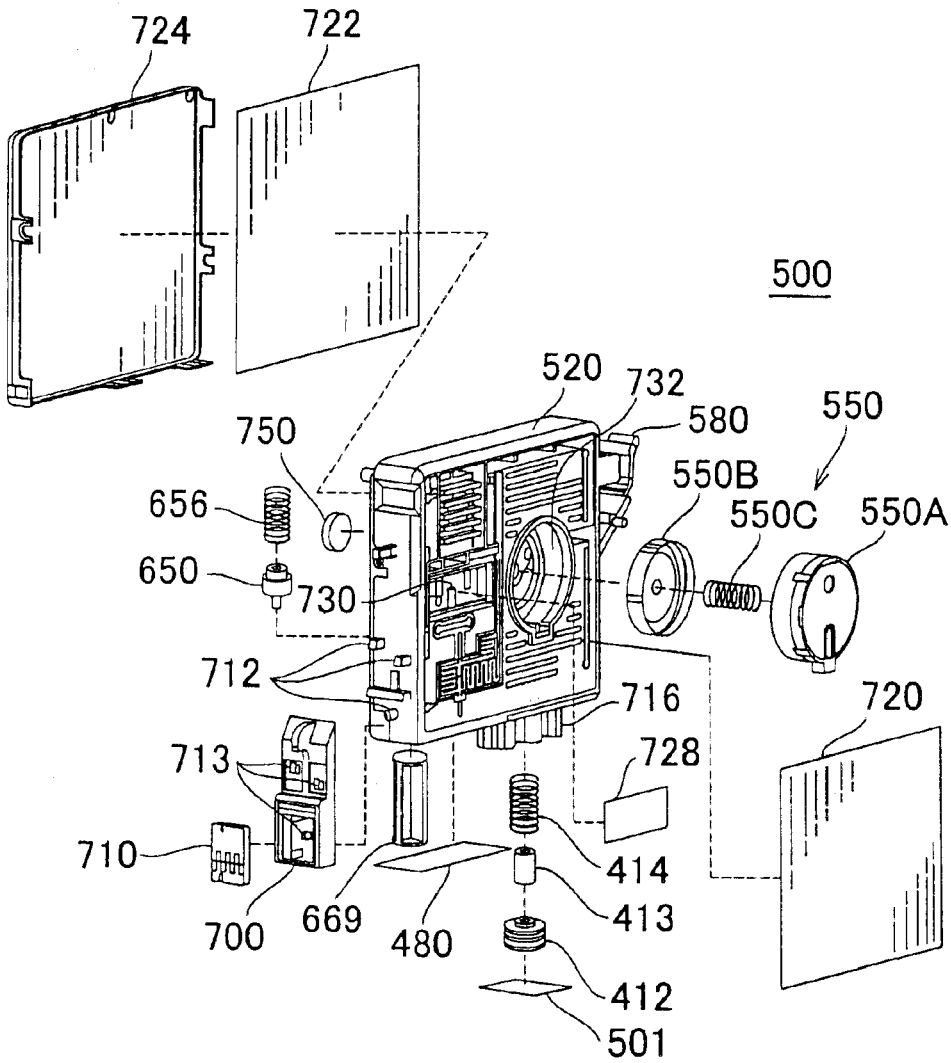
FIG. 9 is an exploded front perspective view of an ink cartridge according to the second embodiment of the present invention.
Figure 10:
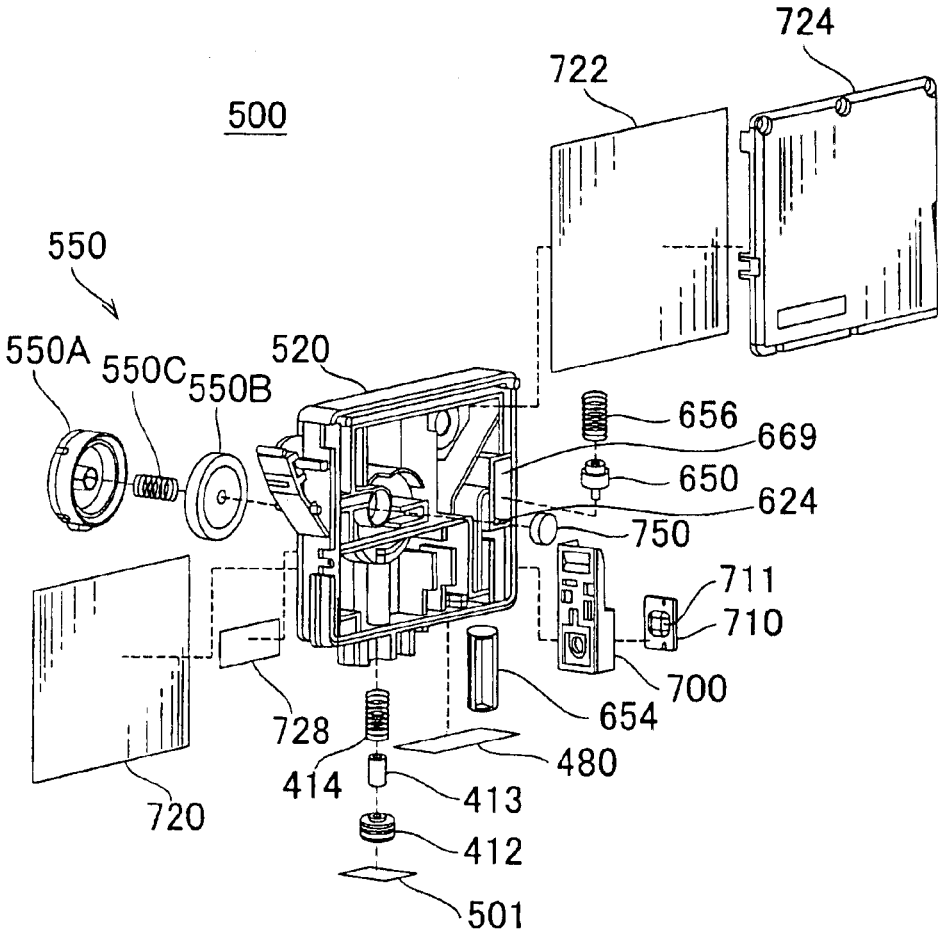
FIG. 10 is an exploded back perspective view of the ink cartridge according to the second embodiment of the present invention.
Figure 11:
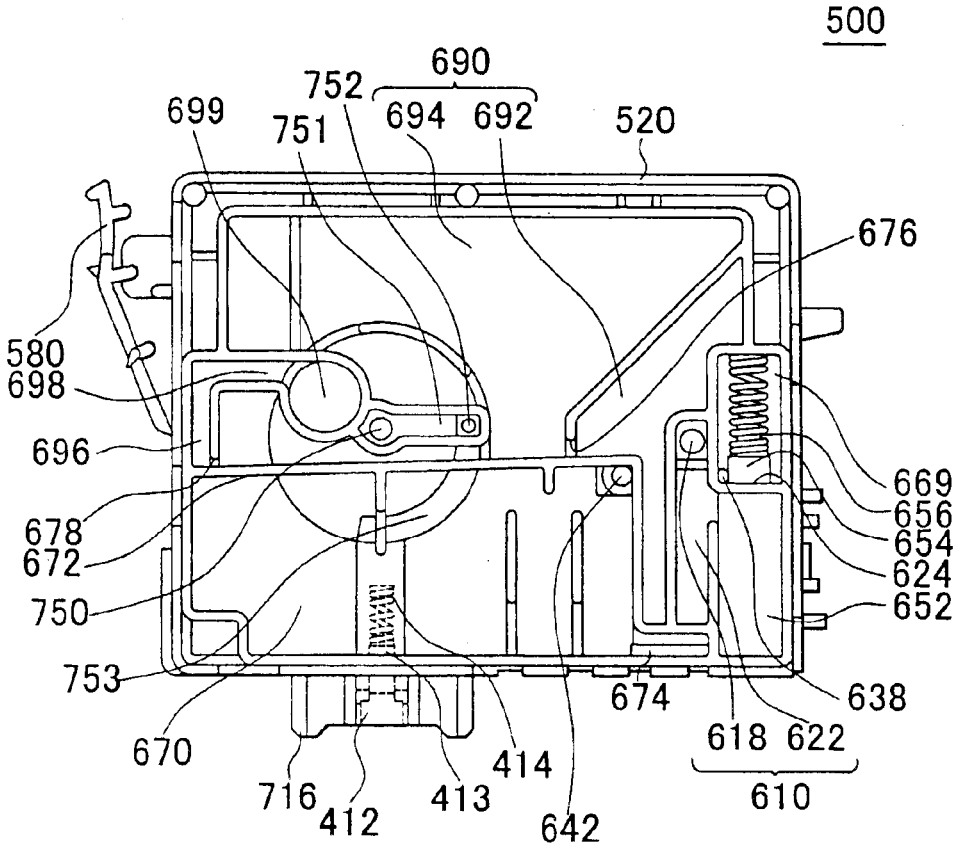
FIG. 11 is a plan view of the ink cartridge according to the second embodiment of the present invention, seen from the back thereof.
Figure 12:
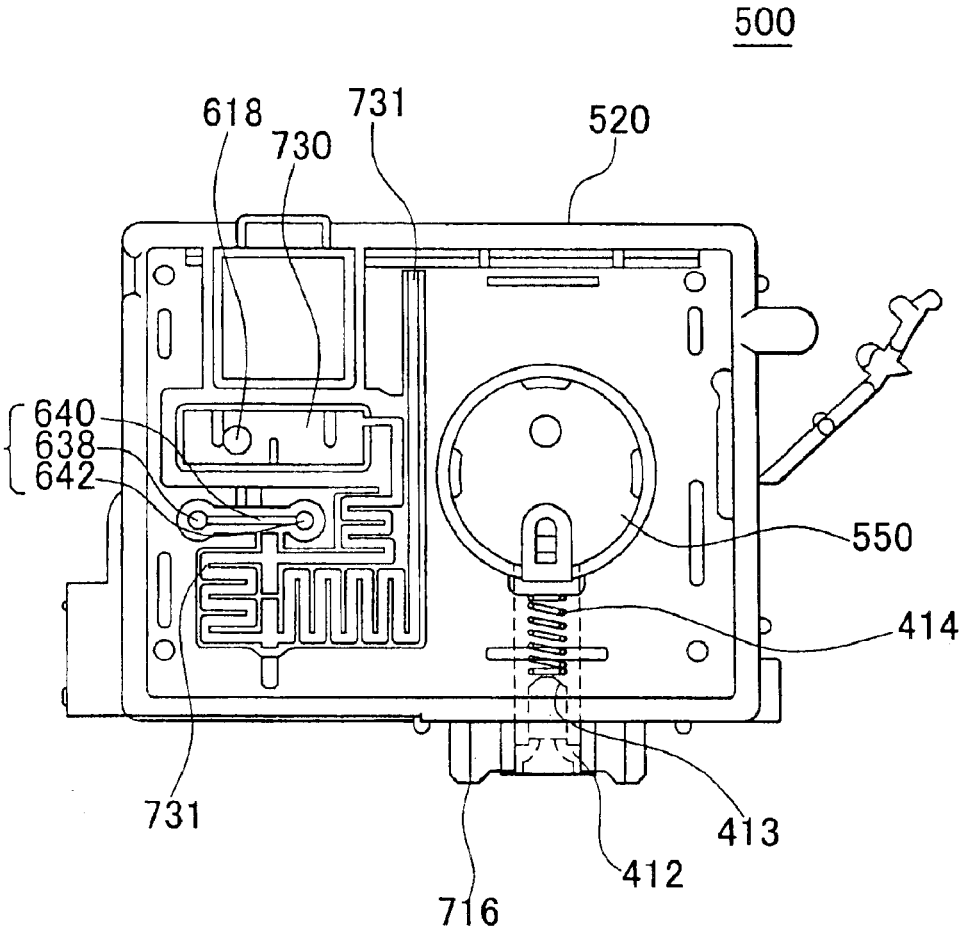
FIG. 12 is a plan view of the ink cartridge according to the second embodiment of the present invention, seen from the front thereof.
Figure 13:
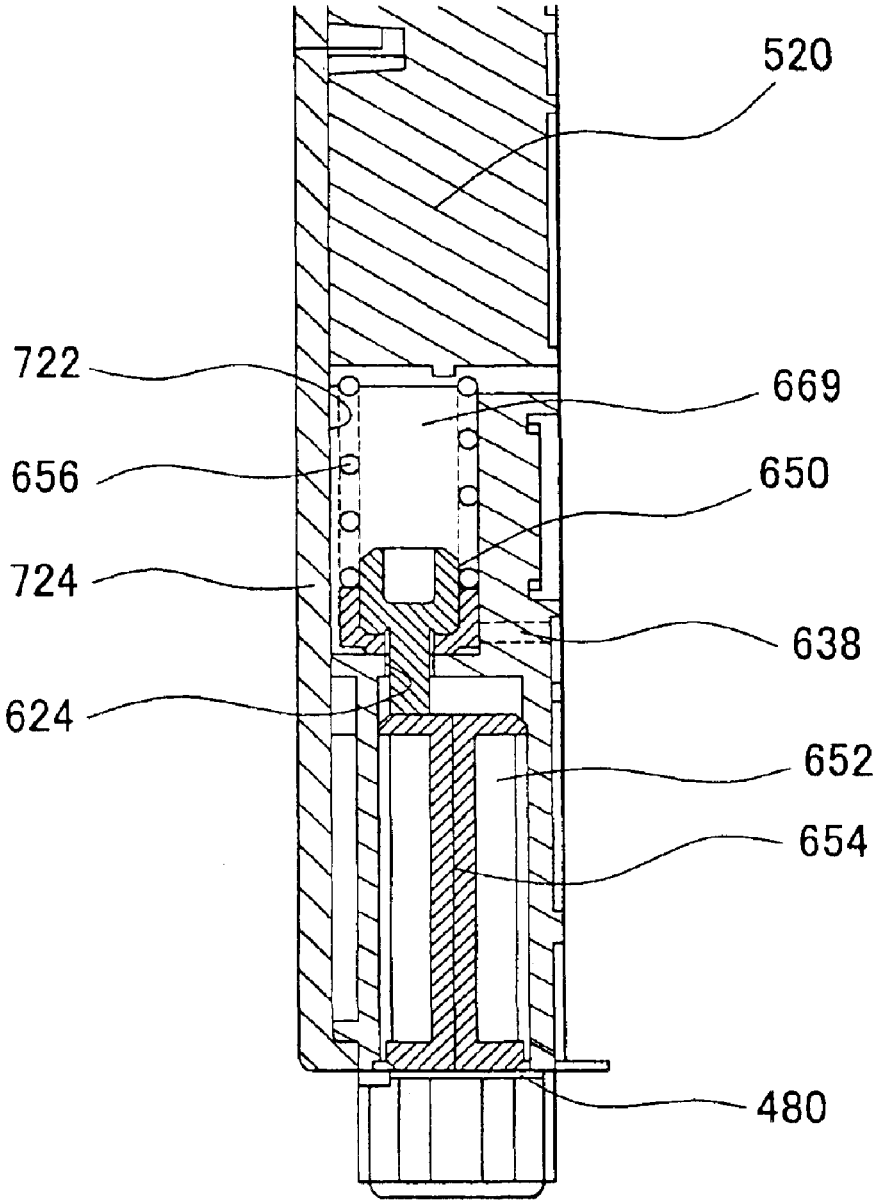
FIG. 13 is an enlarged cross-sectional view around the atmosphere open valve shown in FIGS. 9–12.

FIGS. 9–13 are diagrams for explaining the second embodiment of the present invention. FIG. 9 is an exploded perspective view of an ink cartridge 500 seen from the front thereof; FIG. 10 is an exploded perspective view seen from the back; FIG. 11 is a plan view seen from the back thereof; and FIG. 12 is a plan view seen from the front thereof. Moreover, FIG. 13 is an enlarged cross-sectional view showing a region near the air-releasing valve shown in FIGS. 9–12.

A plurality of protrusions 712 are provided on a side face of a cartridge main body 520. On the other hand, a circuit board 710 with a memory device 711 provided thereon is mounted on a circuit-board accommodating unit 700. By engagement of concave portions 713 of the circuit-board accommodating unit 700 with the protrusions 712, the circuit-board accommodating unit 700 is fixed with respect to the cartridge main body 520. Inside an ink supply port 716, a valve mechanism formed by a spring 414, a sealing member 412 and a valve body 415 is provided. While the ink cartridge 500 is not mounted on the carriage of the ink-jet recording apparatus, this valve mechanism blocks a flow path in the ink supply port 716 to prevent ink leak. Moreover, a film 501 is put to adhere to an opening of the ink supply port 716 when the ink cartridge 500 was shipped, thereby the ink supply port 716 is sealed tightly. A lock lever 580 is operated by the user when the user mounts the ink cartridge 500 onto the ink-jet recording apparatus. While the ink cartridge 500 is placed in the ink-jet recording apparatus, the lock lever 580 engages with a part of the carriage so as to prevent the ink cartridge 500 from being detached from the carriage.

On a concave portion 730 serving as a part of the air passage, a filter 728 is put to adhere thereto. The filter 728 is the same in structure and material as the filter 50 in the first embodiment. Moreover, to the concave portion 730 is connected an end of the passage arranged to wind like a maze. The other end of the passage is formed to be opened to the atmosphere.

Into a circular concave portion 732 that serves as a part of the ink flow path, an ink supply control section 550 is fitted which is formed by a cap 550A, a diaphragm valve 550B and a spring 550C.

As shown in FIG. 10, a plurality of ink chambers detailed later are provided on the backside of the ink cartridge 500. Since a filter 750 has the same function as that of the filter 342 in the first embodiment, that is shown in FIG. 6A, the description of the filter 750 is omitted here.

As shown in FIGS. 11 and 13, a valve accommodating room 669 is formed by a film 722 and a cartridge main body 520. The film 722 seals the valve accommodating room 669. Outside the film 722, an outside wall 724 is attached to protect the film 722 from being broken. On the bottom of the valve accommodating room 669 is formed an atmosphere communication portion 624. Inside the valve accommodating room 669, an air-releasing valve member 650 is inserted together with a coil spring 656. The air-releasing valve member 650 is formed by a core of relatively hard material, such as polypropylene, and an elastic body of relatively soft material such as elastomer, provided in surroundings of the core. The core and elastic body of the air-releasing valve member 650 are formed integrally therewith. The air-releasing valve member 650 is pressed in an elastic manner against the peripheral region of the atmosphere communication portion 624 to seal the portion 624 with an elastic force applied by the coil spring 656. From the atmosphere communication portion 624, the tip of a smaller-diameter part of the air-releasing valve member 650 at the lower end projects. This projecting tip can be brought into contact with one end of an air-releasing valve pressing member 654 accommodated in a pressing member accommodating room 652 arranged below the valve accommodating room 669. The other end of the air-releasing valve pressing member 654 is sealed within the pressing member accommodating room 652 with a film 480 for sealing the bottom opening of the pressing member accommodating room 652. When the ink cartridge 500 has been mounted on the carriage of the ink-jet recording apparatus, a part (projection) of the carriage presses the air-releasing valve member 650 upward via the air-releasing valve pressing member 654, thereby opening the atmosphere communication portion 624.

As described above, in the first embodiment shown in FIGS. 4 and 5A–5C, the inside-outside communication hole 26 extends in a direction perpendicular to the mounting direction of the ink cartridge 10. The opening/closing of the inside-outside communication hole 26 is achieved by the hammer 62 that moves in the same direction as the extending direction of the communication hole 26. On the other hand, in the second embodiment shown in FIGS. 9–13, the atmosphere communication portion 624 extends substantially in parallel to the mounting direction of the ink cartridge 500, and is arranged to be opened or closed by movement of the air-releasing valve member 650 in the mounting direction of the ink cartridge 500.

The cartridge main body 520 includes an atmosphere-side passage when the atmosphere communication portion 624 is assumed as boarder, which is formed by the pressing member accommodating room 652 that is in communication with the atmosphere side; an air passage 622 for communicating with the pressing member accommodating room 652; a hole 618 for achieving communication between the air passage 622 and a concave portion 730; and an passage 731 arranged like a winding maze, for communicating with the concave portion 730. The passage 731 is turned to be a single passage by being sealed with the film 720.

On the other hand, the cartridge main body 520 also includes an ink-side passage on the ink-chamber side of the atmosphere communication portion 624 as boarder, which is formed by the valve accommodating room 669, a hole 638 formed in the wall of the valve accommodating room 669, a communication hole 642 for communicating with the hole 638 through a groove 640 (see FIG. 12) formed in the front region of the cartridge main body 520.

The communication hole 642 communicates with the first ink chamber 670 formed at a lower part of the ink cartridge 500, and the first ink chamber 670 in turn communicates with the second ink chamber 690 via an ink supply path.

The second ink chamber 690 communicates with an ink supply port 716 via the ink supply control section 550.

Since a direction of sliding movement of the air-releasing valve pressing member 654 is parallel to the mounting direction of the ink cartridge 500 onto the ink-jet recording apparatus, each stroke of sliding movement of the air-releasing valve pressing member 654 can be made larger without widening the size of the ink cartridge 500 in the width direction.

The first ink chamber (atmosphere-side ink accommodating portion) 670 is provided below a wall 672 that extends in substantially horizontal direction substantially at the center in the vertical direction of the cartridge main body 520. As described above, the atmosphere-side ink accommodating portion 670 is connected at the upper part thereof to the communication hole 642.

The second ink chamber (supply-side ink accommodating portion) 690 is provided above the wall 672. The supply-side ink accommodating portion 690 includes the first accommodating part 692 that is connected to the atmosphere-side ink accommodating portion 670 via a hole 674 and extends in the vertical direction thereof. The supply-port ink accommodating portion 690 further includes the second accommodating part 694 arranged above the atmosphere-side ink accommodating portion 670. The second accommodating part 694 is connected via a hole 676 provided at a lower position thereof to the first accommodating part 692. The supply-side ink accommodating portion 690 further includes an ink supply path 696 arranged to be surrounded by the second accommodating part 694. The ink supply path 696 communicates with the second accommodating part 694 via a hole 678 provided at a lower position of the ink supply path 696, and also communicates with the ink supply control section 550 via a passage 698 and a filter accommodating room 699. The ink supply control section 550 and the ink supply port 412 are connected to each other by a flow path including a hole 750, a groove 751, a hole 752 and a groove 753 formed on the front side of the cartridge main body 520 in that order.

The details of the ink consuming operation of the ink cartridge 500 in the second embodiment of the present invention, shown in FIGS. 9–13 and the operation for introducing the atmospheric air are omitted because they are not the subject of the present invention.

Figure 14:
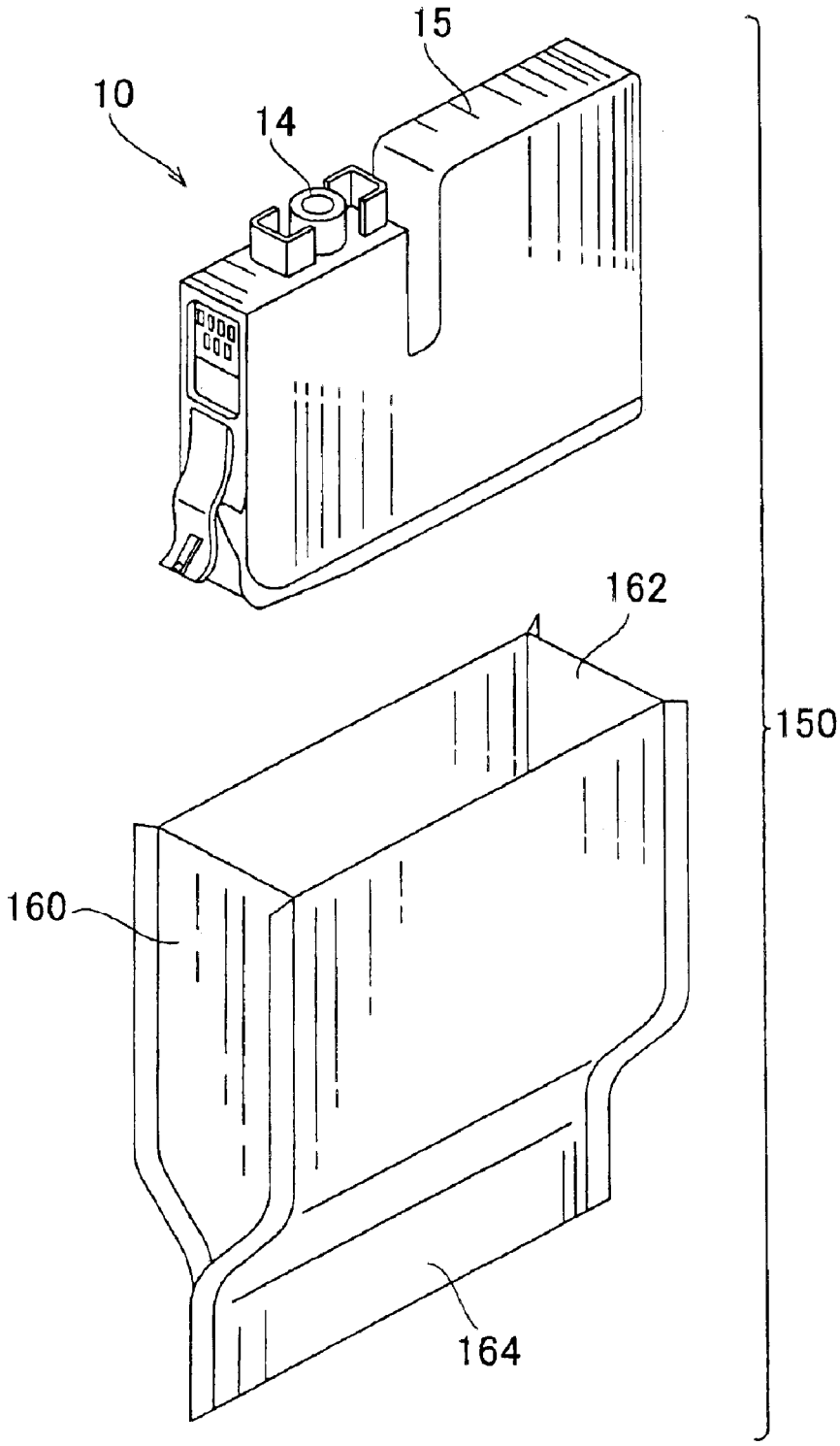
FIG. 14 is a perspective view of a vacuum-packaging product containing the ink cartridge, showing an initial state of vacuum packaging.

FIG. 14 is a perspective view showing an initial state of vacuum-packing of a vacuum-packaging product 150 including an ink cartridge. The vacuum-packaging product 150 includes the ink cartridge 10 and an outer packaging member 160. The description of the ink cartridge 10 is omitted because it was made in the above. The ink cartridge 10 to be packed may be a cartridge filled with ink during manufacturing or a cartridge re-filled with ink after ink in the cartridge was used.

The outer packaging member 160 is like an approximately prismatic bag which includes an opening 162 on one side and a sealed portion 164 on the other side, in the state before the ink cartridge 10 is inserted into the outer packaging member 160. In the present embodiment, the outer packaging member 160 is formed of airtight material, for example, aluminum. The outer packaging member 160 is held with the opening 162 faced upward in the present embodiment.

In FIG. 14, the ink cartridge 10 is arranged to be reversed from the arrangement in FIG. 1 so that the ink supply port 14 faces upward. In this state, the ink cartridge 10 is inserted into the inside of the outer packaging member 160 via the opening 162 of the outer packaging member 160.

Then, the pressure inside the outer packaging member 160 with the ink cartridge 10 inserted therein is reduced. In the present embodiment, the outer packaging member 160 with the ink cartridge 10 inserted therein is set in a decompressor and the pressure inside the outer packaging member 160 is reduced by letting air out of the opening 162 of the outer packaging member 160.

Figure 15:
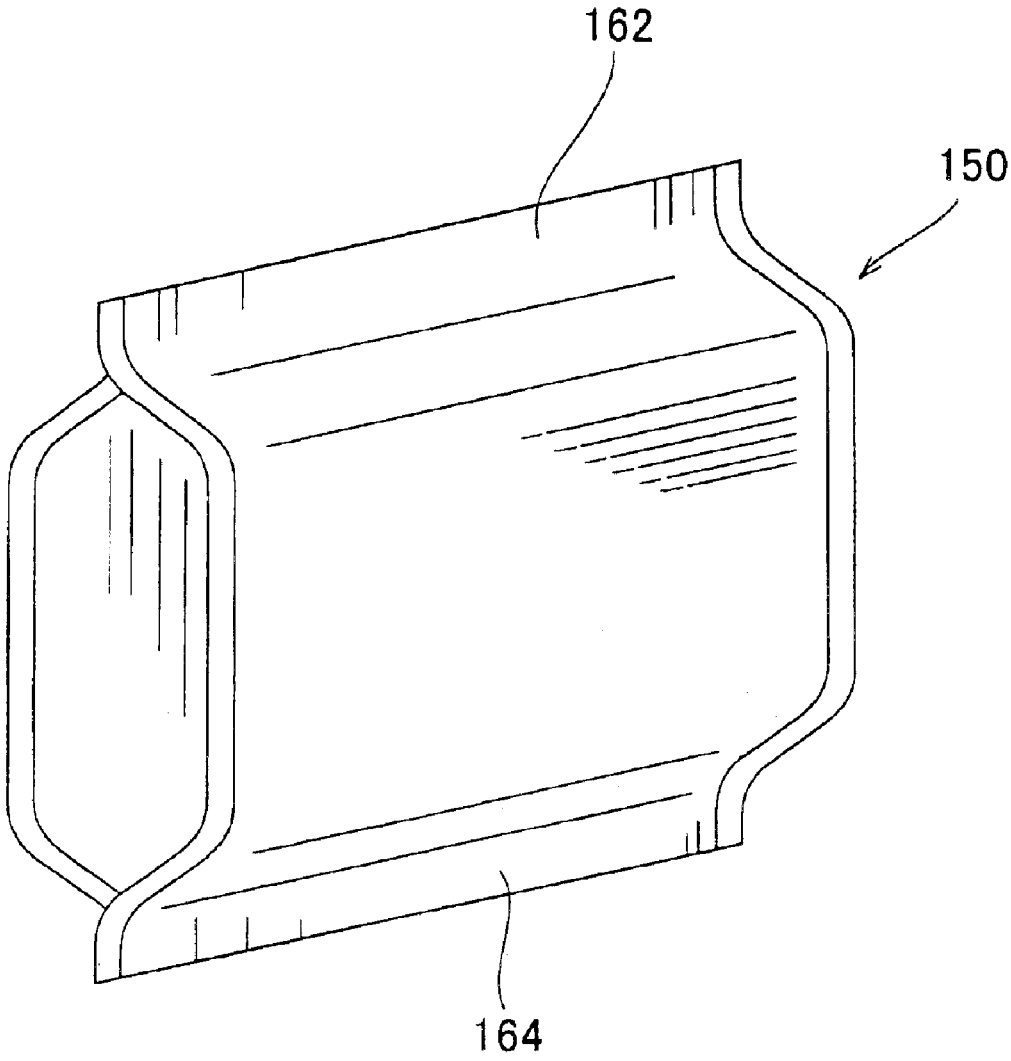
FIG. 15 is a perspective view of the vacuum-packaging product containing the ink cartridge, showing a state in which an opening of an outer packaging member is sealed.

FIG. 15 is a perspective view showing the opening 162 of the outer packaging member 160 of the vacuum-packaging product 150 is sealed. In the state where the pressure inside the outer packaging member 160 with the ink cartridge 10 inserted therein has been reduced, the opening 162 of the outer packaging member 160 is sealed. In the present embodiment, this sealing is achieved by heat welding, for example.

After this sealing, the outer packaging member 160 with the ink cartridge 10 inserted therein is brought out from the decompressor, thereby generating pressure difference between the inside and outside of the outer packaging member 160. Thus, the outer packaging member 160 shrinks to seal the ink cartridge 10 with a reduced pressure in an airtight manner.

Since the pressure inside the outer packaging member 160 is reduced, in the ink cartridge 10 thus vacuum-packed with the outer packaging member 160, air is sucked toward the outside of the ink cartridge 10 from the atmosphere-side passage 40 via an opening 54. In other words, a negative pressure obtained by pressure reduction in the outside of the ink cartridge 10 affects on the atmosphere-side passage 40, resulting application of a force to the air-releasing valve 70 to a direction toward the atmosphere-side passage 40, i.e., to the right in FIG. 6A.

Here, it is assumed that the ink cartridge in the vacuum-packaging product is a cartridge in which the air passage is closed by inserting the air-releasing valve 70 from the side of the atmosphere-side passage 40 (from the right in FIG. 7) into the inside-outside communication hole 26 and also pressing the air-releasing valve 70 from the side of the atmosphere-side passage 40 (from the right to the left in FIG. 7) by means of the pressing member 80. In this case, a force is applied to the air-releasing valve 70 in a direction which opens the inside-outside communication hole 26 because of the negative pressure caused by the pressure reduction inside the outer packaging member 160. Thus, in this case, the pressing force of the pressing member 80 should be set large enough to prevent the air-releasing valve 70 from being opened by the above negative pressure to cause ink leak.

On the other hand, in the ink cartridge 10 of the present embodiment, the air-releasing valve 70 is inserted into the inside-outside communication hole 26 from the side of the ink-chamber side passage 30 (from the left in FIG. 7), and the pressing member 80 presses the air-releasing valve 70 from the side of the ink-chamber side passage 30 (from the left to the right in FIG. 7). Thus, in the present embodiment, a force is applied to the air-releasing valve 70 in a direction which closes the inside-outside communication hole 26 by the negative pressure caused by the pressure reduction inside the outer packaging member 160.

Therefore, according to the present embodiment, unlike the aforementioned case, it is unnecessary to set the pressing force of the pressing member 80 larger enough to prevent the air-releasing valve 70 from being opened to cause ink leak. Especially, even in a case where the pressing member 80 is formed by a spring such as a plate spring, it is possible to prevent generation of creep in a direction which makes the pressing force for pressing the air-releasing valve 70 weaker. Instead, in the vacuum-packed state, the force applied by the negative pressure is applied to the air-releasing valve 70, thereby the air-releasing valve 70 can close the air passage more steadily. Moreover, since the pressing force for pressing the air-releasing valve 70 can be made smeller, the mechanism of the pressing member 80 such as a plate spring can be simplified, thus reducing the cost. Therefore, while the ink cartridge 10 is not mounted onto the ink-jet recording apparatus, it is possible to close the air passage without fail, thereby preventing ink leakage or preventing ink characteristics from varying, for example, viscosity from changing to high, due to evaporation of solvent contained in the ink.

The above embodiments may be modified in such a manner that porous material is included in the ink chamber, if required, to cause ink absorption so as to place the ink chamber in the negative pressure state.

As is apparent from the above, according to the present invention, while the ink cartridge is not mounted onto the ink-jet recording apparatus, it is possible to close the air passage without fail, thereby preventing ink leakage and also preventing ink characteristics from varying, for example, viscosity from changing to high due to evaporation of solvent contained in the ink.

Although the present invention has been described by way of exemplary embodiments, it should be understood that those skilled in the art might make many changes and substitutions without departing from the spirit and the scope of the present invention which is defined only by the appended claims.

What is claimed is:

1. An ink cartridge detachably mountable on an ink-jet printing apparatus, comprising:

an ink accommodating portion for holding ink;

an air passage through which said ink accommodating portion communicates with the atmosphere;

a valve mechanism, provided in said air passage, including an air-releasing valve member that can seal from a certain sealing direction a communication hole provided in a partition wall that separates an ink-accommodating-portion side of the ink cartridge, that is a side close to said ink accommodating portion, from an atmosphere side of the ink cartridge, that is a side close to the atmosphere, the sealing direction being from said ink-accommodating-portion side toward said atmosphere side; and a pressing member that presses said air-releasing valve member in a direction from said accommodating portion side toward the atmosphere side, wherein said air-releasing valve member comprises a pressed portion pressed by said pressing member at said ink-accommodating portion side of the ink cartridge, and said air-releasing valve member further comprises a contact portion that opens said air passage in response to an applied external force, transmitted through a part of the printing apparatus when the ink cartridge is mounted on the printing apparatus, from said atmosphere side toward said ink-accommodating-portion side.

2. An ink cartridge as in claim 1, wherein said air passage includes a winding passage and a breathable filter that repels liquid arranged in that order from said atmosphere, and said valve mechanism is located between said filter and said ink accommodating portion.

3. An ink cartridge as in claim 1, further comprising a hammer movable about an axis and which comes into contact with said contact portion of said air-releasing valve member to open said air passage.

4. An ink cartridge as in claim 3, wherein said hammer moves around said axis in a direction perpendicular to a mounting direction of said ink cartridge onto the printing apparatus.

5. An ink cartridge as in claim 1, further comprising an air-releasing valve pressing member that moves substantially in parallel to a mounting direction of said ink cartridge onto the printing apparatus, and said contact portion is pressed by said air-releasing valve pressing member to open said air passage.

6. An ink cartridge as in claim 5, wherein said air-releasing valve member has a projecting portion extending along said mounting direction of said ink cartridge onto the printing apparatus to project from said communication hole toward said atmosphere side, said projecting portion being configures so as to be pressed by said air-releasing valve pressing member.

7. An ink cartridge as in claim 5, further comprising a pressing member that presses said air-releasing valve member with an elastic force in a direction of said mounting direction of said ink cartridge onto the printing apparatus.

8. An ink cartridge as in claim 3, further comprising:

a film located between the contact portion and the hammer, wherein said contact portion is pressed by said hammer via the film located therebetween.

9. An ink cartridge as in claim 5, wherein a face of a section accommodating said air-releasing valve pressing member, that is pressed against the printing apparatus, is sealed with a film.

10. A vacuum-packaging product comprising:

an ink cartridge as claimed in any one of the preceding claims; and a bag-like outer packaging member covering said ink cartridge, wherein a pressure inside said outer packaging member is reduced to seal said ink cartridge.

11. An ink cartridge as in claim 1, further comprising:

a space that is formed at said ink accommodating portion side, said space accommodating therein a part of said valve mechanism member; and an ink passage that connects said space with said ink accommodating portion.

12. An ink cartridge as in claim 1, further comprising:

an ink supply port, wherein said air passage includes a portion where the air communication with the atmosphere is operated, and said portion is located on a same side as said ink supply port.

13. An ink cartridge as in claim 1, wherein said pressing member is formed from resin.

14. An ink cartridge as in claim 12, wherein said part of said valve mechanism is said pressing member.

15. An ink cartridge as in claim 1, wherein said pressing member contacts the air-releasing valve member at a first position, said contact portion of said air-releasing valve member is located at a second position, and the first position is closer to the ink-accommodating portion than the second position.

16. An ink cartridge as in claim 1, wherein said pressing member is located behind said air-releasing valve member with respect to the sealing direction from said ink-accommodating portion said toward said atmosphere side.

17. An ink cartridge as in claim 1, wherein an area of said pressed portion of said air-releasing valve member is larger than an area of said contact portion thereof.

* * * * *